US010358899B2

(12) United States Patent
El Mallawany et al.

(10) Patent No.: US 10,358,899 B2
(45) Date of Patent: Jul. 23, 2019

(54) DOWNHOLE FLOW CONTROL ASSEMBLIES AND EROSION MITIGATION

(71) Applicant: Halliburton Energy Services, Inc., Houston, TX (US)

(72) Inventors: Ibrahim El Mallawany, Spring, TX (US); Pranay Asthana, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 148 days.

(21) Appl. No.: 15/505,065

(22) PCT Filed: Mar. 17, 2016

(86) PCT No.: PCT/US2016/022795

§ 371 (c)(1),
(2) Date: Feb. 17, 2017

(87) PCT Pub. No.: WO2017/160291

PCT Pub. Date: Sep. 21, 2017

(65) Prior Publication Data

US 2018/0163521 A1 Jun. 14, 2018

(51) Int. Cl.
*E21B 34/14* (2006.01)
*E21B 43/12* (2006.01)
(Continued)

(52) U.S. Cl.
CPC ..... *E21B 43/12* (2013.01); *E21B 34/06* (2013.01); *E21B 34/14* (2013.01); *E21B 43/14* (2013.01); *E21B 43/38* (2013.01)

(58) Field of Classification Search
CPC ..... E21B 34/14; E21B 34/12; E21B 2034/007
See application file for complete search history.

(56) References Cited

U.S. PATENT DOCUMENTS 5,979,558 A 11/1999 Bouldin et al.
6,371,208 B1 * 4/2002 Norman ..... E21B 34/06 166/334.4

(Continued)

FOREIGN PATENT DOCUMENTS

WO WO-01/31167 A1 5/2001

OTHER PUBLICATIONS

International Search Report and Written Opinion from PCT/US2016/022795, dated Nov. 21, 2016.

*Primary Examiner* — Giovanna C Wright
(74) *Attorney, Agent, or Firm* — Benjamin Fite; C. Tumey Law Group PLLC

(57) ABSTRACT

A flow control assembly having a body defining a central flow passage and one or more lateral flow openings that facilitate fluid communication between the central flow passage and an exterior of the body, and a flow trim positioned within the central flow passage and defining one or more flow orifices aligned with the lateral flow openings. A flow closure member is positioned within the central flow passage and movable between a closed position, where the lateral flow openings and the flow orifices are occluded to prevent fluid flow through the lateral flow openings, and an open position, where the lateral flow openings and the flow orifices are at least partially exposed to facilitate fluid flow through the lateral flow openings. A sacrificial nose radially interposes the flow closure member and the flow trim to mitigate erosion of the flow closure member.

18 Claims, 12 Drawing Sheets

(51) Int. Cl.

| | |
|---|---|
| ***E21B 34/06*** | (2006.01) |
| ***E21B 43/14*** | (2006.01) |
| ***E21B 43/38*** | (2006.01) |

(56) References Cited

U.S. PATENT DOCUMENTS

| | | | | |
|---|---|---|---|---|
| 6,422,317 | B1 | 7/2002 | Williamson, Jr. | |
| 9,068,443 | B2 * | 6/2015 | Jefferies | E21B 34/14 |
| 2011/0297254 | A1 * | 12/2011 | Geddes | E21B 34/101 137/528 |
| 2014/0224342 | A1 | 8/2014 | Bao et al. | |
| 2014/0332229 | A1 | 11/2014 | Greci | |
| 2015/0013989 | A1 | 1/2015 | Patwa et al. | |

* cited by examiner

DOWNHOLE FLOW CONTROL ASSEMBLIES AND EROSION MITIGATION

CROSS-REFERENCE TO RELATED APPLICATIONS

The present application claims the benefit of priority under 35 U.S.C. § 371 as a national phase of International Application Serial No. PCT/US2016/022795 titled "Downhole Flow Control Assemblies and Erosion Mitigation," and filed on Mar. 17, 2016, the disclosure of which is hereby incorporated by reference in its entirety for all purposes.

BACKGROUND

Flow control devices, such as sliding or rotating sleeve assemblies and downhole valves, are often included in downhole completions to selectively regulate fluid flow into and out of production tubing during hydrocarbon recovery operations. The flow control devices typically include a choke used to throttle (alternately referred to as "choke") the fluid flow and thereby provide adjustable flow metering and pressure control between a surrounding well annulus and the production tubing at the maximum possible flowing differential pressure.

Chokes used in flow control devices are also designed to facilitate a long service life against erosion due to solid laden produced fluids. Due to the extremely high flow velocities commonly experienced in downhole choke operation, the standardized industry materials of choice for chokes include carbides (e.g., tungsten carbide) or equivalent hard ceramics and ceramic alloys that mitigate erosion. Various design features can be incorporated into the chokes and their associated component parts to mitigate material erosion caused by the high velocity flow of solid laden fluids.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present invention relates generally to systems used to control fluid flow in subterranean wells and, more particularly, to flow control assemblies that incorporate chokes and related assemblies that selectively regulate fluid flow into or out of tubing positioned within a subterranean well.

The flow control assemblies described herein can be used in production and/or injection operations. One example flow control assembly includes a cylindrical body that defines a central flow passage and one or more lateral flow openings that facilitate fluid communication between the central flow passage and an exterior of the body. A flow trim is positioned within the central flow passage and defines one or more flow orifices that extend helically about a circumference of the flow trim and are aligned with the lateral flow openings. A flow closure member is positioned within the central flow passage and is movable between a closed position, where the lateral flow openings and the flow orifices are occluded to prevent fluid flow through the openings, and an open position, where the lateral flow openings and the flow orifices are at least partially exposed to facilitate fluid flow through the openings. One advantage provided by the above-described flow control assembly is that, as the flow closure member moves toward the open position, fluid entering the central flow passage via the lateral flow openings traverses the helical flow orifice(s), which directs the fluid such that it impinges upon the flow closure member at progressively different angular locations along a circumference of the flow closure member. As a result, erosion of the flow closure member will be spread across a larger area as compared to conventional flow control assemblies.

Another example flow control assembly includes a sacrificial nose that radially interposes the flow closure member and the flow trim and operates to mitigate erosion of the flow closure member from incoming fluid flow through the openings and the flow orifices. A flow trim with the helical flow orifices may or may not be used in this example. As the flow closure member moves toward the open position it is received within the sacrificial nose, which extends axially past an axial end of the flow closure member. As a result, as the flow closure member moves toward the open position and fluid is able to traverse the flow trim, the incoming fluid will impinge upon the sacrificial nose instead of the flow closure member, whereby the sacrificial nose assumes any erosive effects caused by the incoming flow of the fluid.

Figure 1:
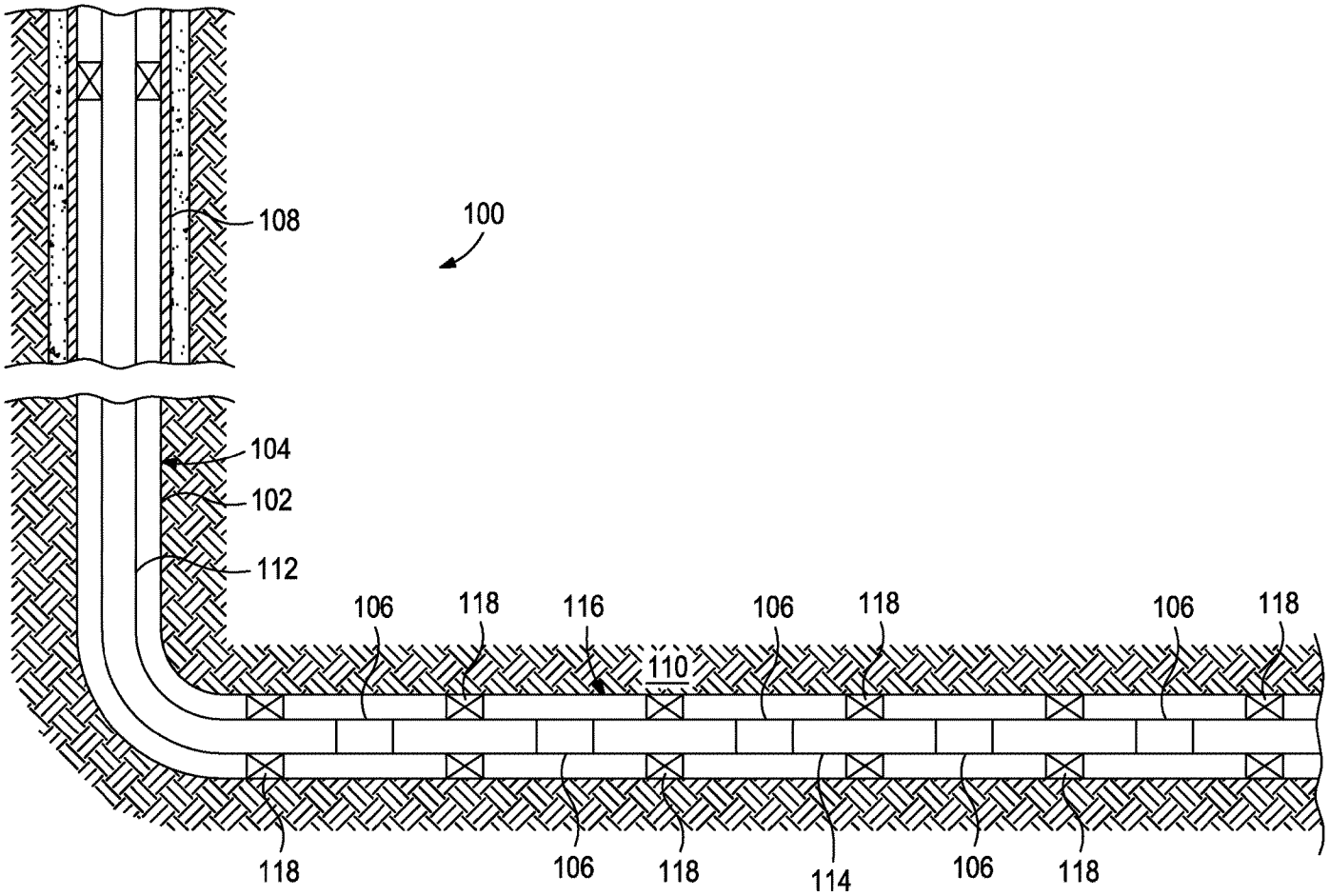
FIG. 1 is a schematic diagram f a well system that may employ the principles of the present disclosure.

Referring to FIG. 1, illustrated is a well system 100 that may employ the principles of the present disclosure, according to one or more embodiments. As depicted, the well system 100 includes a wellbore 102 that extends through various earth strata and has a substantially vertical section 104 that transitions into a substantially horizontal section 106. The upper portion of the vertical section 104 may have a string of casing 108 cemented therein, and the horizontal section 106 may extend through a hydrocarbon bearing subterranean formation 110. In at least one embodiment, the horizontal section 106 may comprise an open hole section of the wellbore 102. In other embodiments, however, the casing 108 may extend into the horizontal section 106.

A string of pipe or tubing 112 may be positioned within the wellbore 102 and extend from a well surface (not shown), such as a production rig, a production platform, or the like. In some cases, the tubing 112 may comprise a string of multiple pipes coupled end to end and extended into the wellbore 102. In other cases, the tubing 112 may comprise a continuous length of tubing, such as coiled tubing or the like. At its lower end, the tubing 112 may be coupled to and otherwise form part of a downhole completion 114 arranged within the horizontal section 106. The downhole completion 114 serves to divide wellbore 102 into various production intervals adjacent the formation 110. In production operations, the tubing 112 provides a conduit for fluids extracted from the formation 110 to travel to the well surface and, therefore, may be characterized as production tubing. In injection operations, however, the tubing 112 provides a conduit for fluids to be injected into the formation 110 and, therefore may be alternatively characterized as injection tubing.

As depicted, the downhole completion 114 may include a plurality of flow control assemblies generically depicted at 116, axially offset from each other along portions of the downhole completion 114. In some applications, each flow control assembly 116 may be positioned between a pair of packers 118 that provides a fluid seal between the downhole completion 114 and the wellbore 102, and thereby defining corresponding intervals along the length of the downhole completion 114. Each flow control assembly 116 may operate to selectively regulate fluid flow into and/or out of the tubing 112, depending on whether a production or an injection operation is being undertaken.

It should be noted that even though FIG. 1 depicts the flow control assemblies 116 as being arranged in an open hole portion of the wellbore 102, embodiments are contemplated herein where one or more of the flow control assemblies 116 is arranged within cased portions of the wellbore 102. Also, even though FIG. 1 depicts a single flow control assembly 116 arranged in each interval, any number of flow control assemblies 116 might be deployed within a particular interval without departing from the scope of the disclosure. In addition, even though FIG. 1 depicts multiple intervals separated by the packers 118, it will be understood by those skilled in the art that the completion interval may include any number of intervals with a corresponding number of packers 118 arranged therein. In other embodiments, the packers 118 may be entirely omitted from the completion interval, without departing from the scope of the disclosure.

While FIG. 1 depicts the flow control assemblies 116 as being arranged in the horizontal section 106 of the wellbore 102, those skilled in the art will readily recognize that the flow control assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
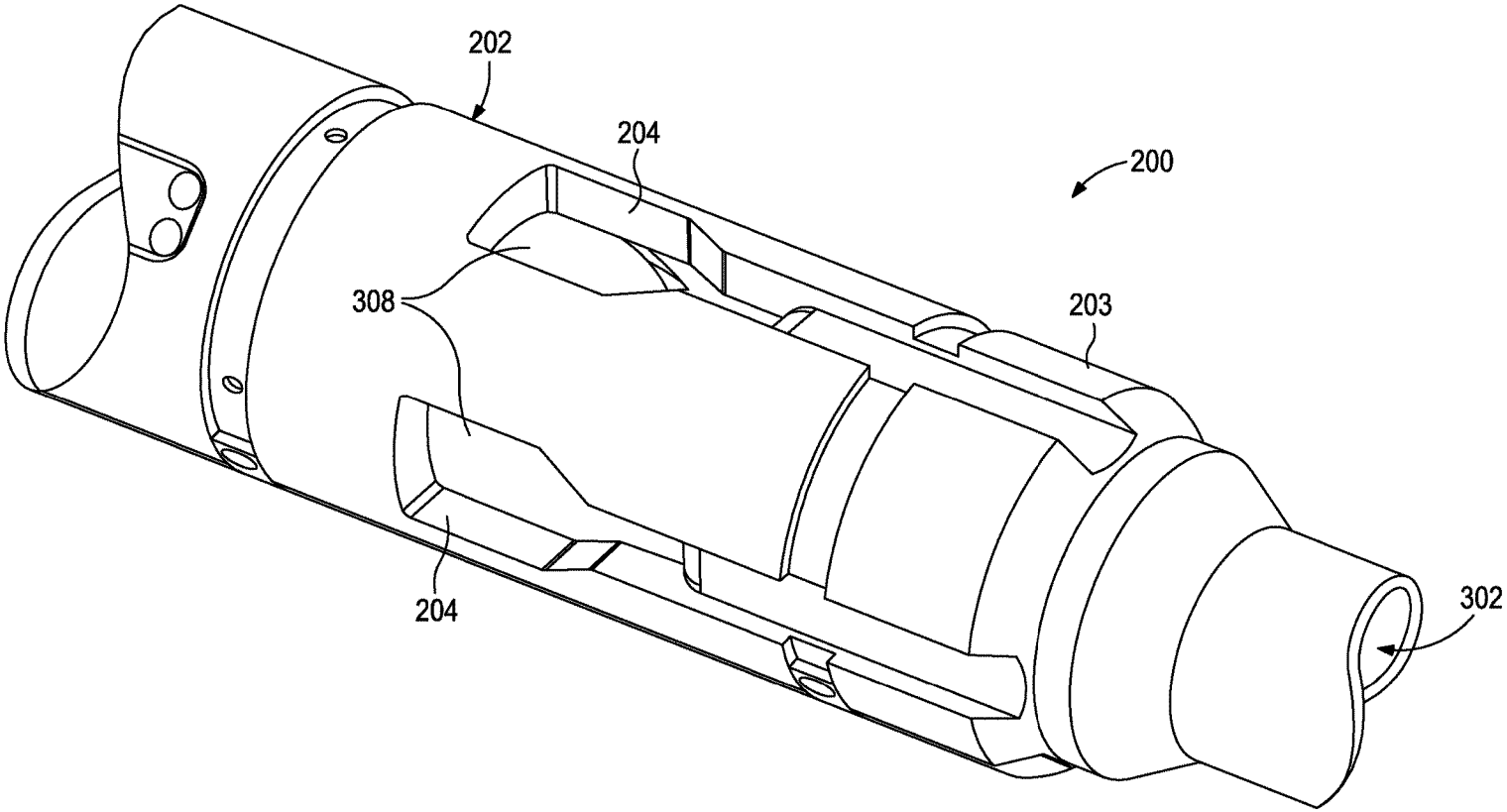
FIG. 2 is an isometric view of an example flow control assembly.

FIG. 2 is an isometric view of an example flow control assembly 200 (hereafter "the assembly 200") that may be provided as one or more of the flow control assemblies 116 depicted in FIG. 1. Accordingly, the assembly 200 may interpose upper and lower portions or lengths of the tubing 112 (FIG. 1) in the downhole completion 114 (FIG. 1) and may be used in both production and injection operations.

The assembly 200 includes an elongate body 202 having an outer wall 203 that defines an interior, central flow passage 302 (further illustrated in FIGS. 3A-3C) through the body 202, and having a plurality of lateral flow openings 204 along the outer wall 203 to provide transverse fluid communication into and/or out of the central flow passage 302. The outer wall 203 has an optionally cylindrical outer surface for conforming to the generally cylindrical interior of a wellbore or casing that line the wellbore. The plurality of openings 204 in this example include four openings 204 (two hidden) angularly offset from each other by 90° about the circumference of the body 202. In other embodiments, however, the body 202 may provide two openings 204 angularly offset from each other by 180°. In yet other embodiments, three openings 204 may be defined in the body 202 and angularly offset from each other by 120°, or more than four openings 204 may be defined in the body 202, such as five or more, without departing from the scope of the disclosure. Although not required, the plurality of openings 204 may be equidistantly spaced from each other about the circumference of the body 202, as in any of the foregoing examples.

The assembly 200 may further include a choke assembly (explained in detail in subsequent figures) arranged within the interior of the body 202 to regulate fluid flow through the openings 204. As described in more detail below, the choke assembly may include a flow trim 308 and a flow closure member 304 (FIGS. 3A-3C) that is actuatable and otherwise movable between a closed position, where fluid flow through the flow trim 308 and the openings 204 is prevented, and an open position, where fluid flow through the flow trim 208 and the openings 204 is allowed.

Figure 3A:
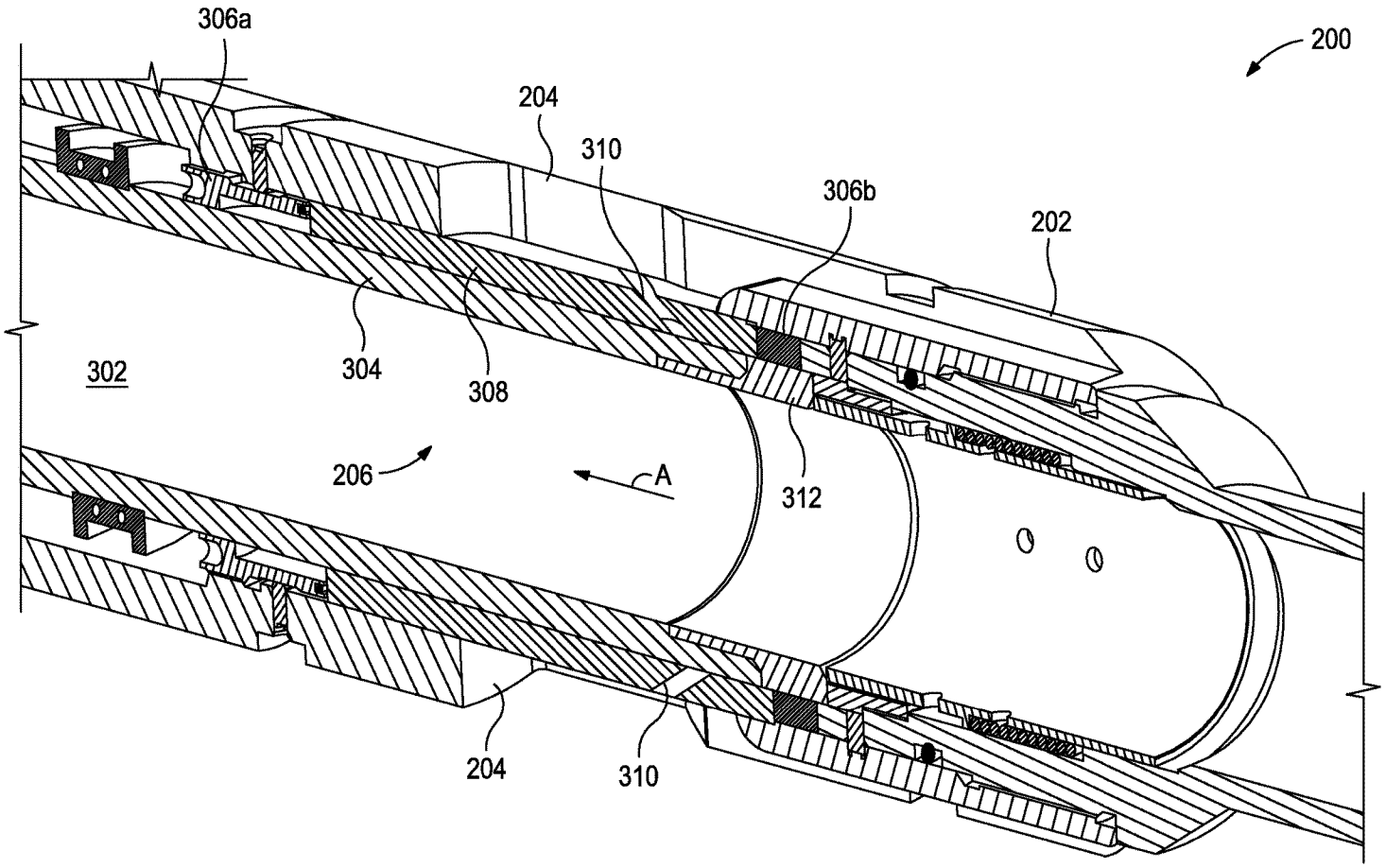
FIGS. 3A-3C depict progressive isometric cross-sectional side views of the flow control assembly of FIG. 2.
Figure 3B:
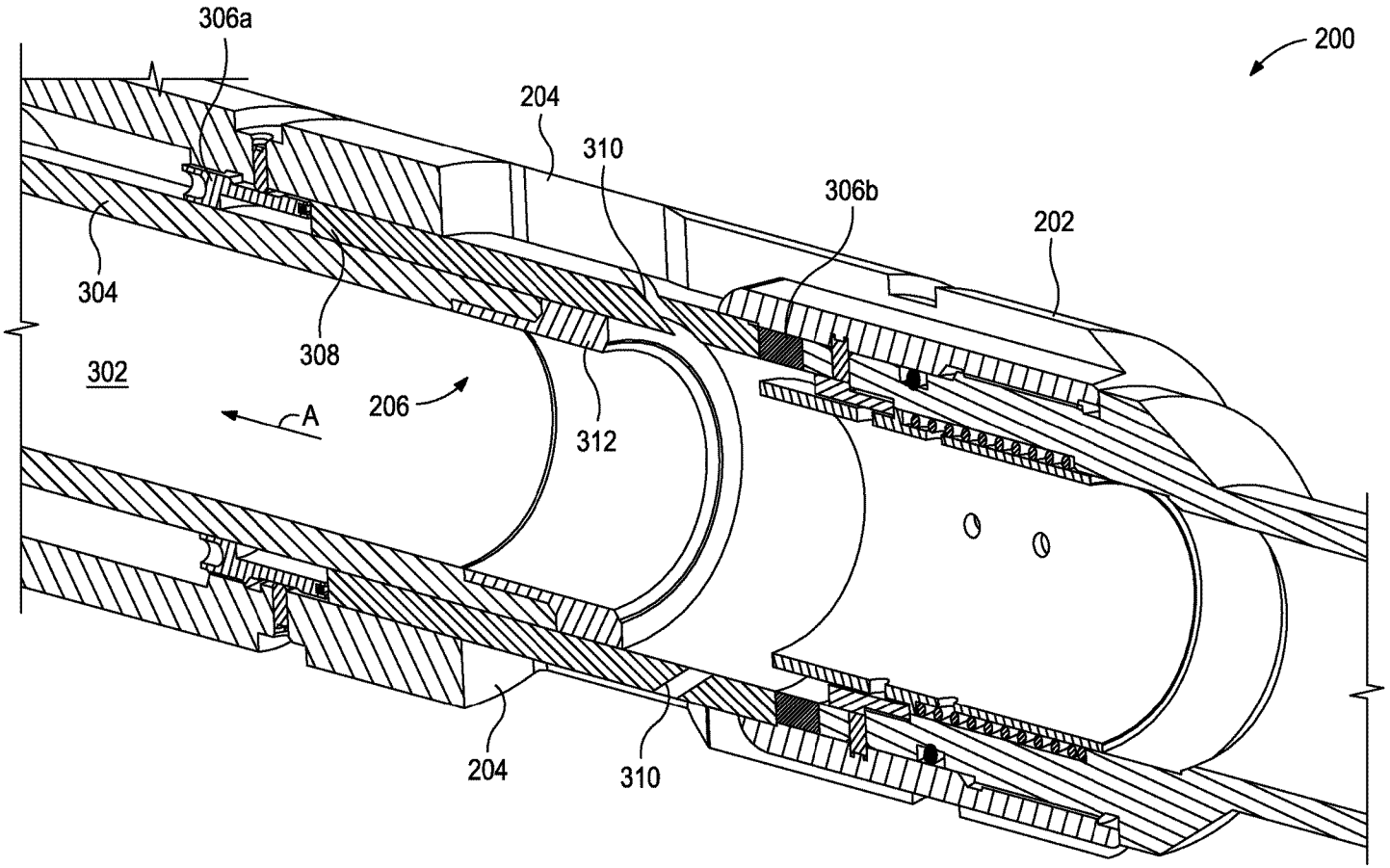
Figure 3C:
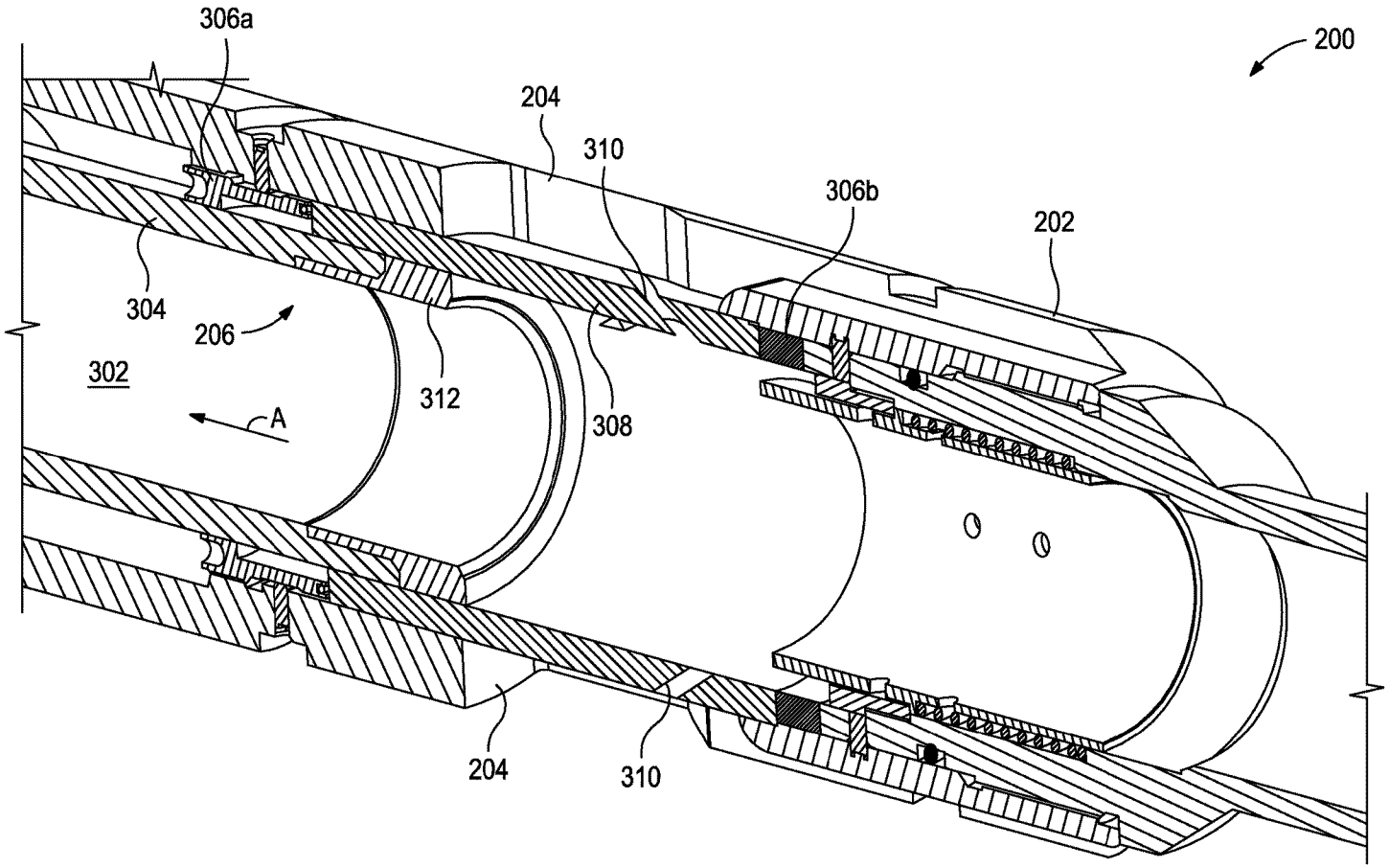

FIGS. 3A-3C are cross-sectional views of the assembly 200 in different operational conditions corresponding to different lateral flow restrictions by virtue of operating a choke assembly 206. More specifically, the illustrated operational conditions include a minimal flow condition in FIG. 3A in which the lateral flow openings 204 are occluded to provide minimal transverse flow (the minimal flow condition in this example is, more specifically, a sealed, substantially fully closed condition in which no appreciable flow is allowed through the lateral flow openings 204), a "partially open" operational condition in FIG. 3B in which the lateral flow openings 204 are less occluded than in FIG. 3A, to allow appreciable transverse flow through the lateral flow openings 204, and a maximal flow condition in FIG. 3C corresponding to the most flow through lateral flow openings 204 allowed by the choke assembly 206 (this may be a "fully open" operational condition in which the lateral flow openings 204 are not appreciably occluded). Certain features introduced in FIG. 2, such as the body 202, the central flow passage 302, and the choke assembly 206 are further detailed in FIGS. 3A-3C.

As illustrated in FIG. 3A, the choke assembly 206 may include a flow closure member 304 movably disposed within the central flow passage 302. In the illustrated embodiment, the flow closure member 304 is depicted as a sliding sleeve that is axially movable within the body 202 between a first or "closed" position (i.e., the minimal flow condition of the assembly 200), as shown in FIG. 3A, and a second or "open" position (i.e., the maximal flow condition of the assembly 200), as shown in FIG. 3C. In other embodiments, however, the flow closure member 304 may comprise a rotating sleeve, a sliding plug, a rotating ball, an oscillating vane, an opening pocket, an opening window, or a valve capable of actuating the assembly 200 between the maximal and minimal conditions, without departing from the scope of the disclosure.

The flow closure member 304 may be selectively actuated between the first and second positions (and any position there between) using any suitable actuation device. In some embodiments, for instance, the flow closure member 304 may be axially moved within the body 202 using a hydraulic actuation device. In other embodiments, however, the flow closure member 304 may be actuated with a mechanical, electromechanical, or pneumatic actuation device, without departing from the scope of the disclosure. The flow closure member 304 may further be selectively actuated from a remote location, such as a surface location. In such embodiments, the actuation device that moves the flow closure member 304 may be communicably coupled to the surface location, and an operator may be able to send command signals downhole to the actuation device to selectively move the flow closure member 304 between the fully open and closed positions (and any position there between) as desired. In other embodiments, however, the flow closure member 304 may be partially or fully automated. In such embodiments, for instance, control of the flow closure member 304 may be dependent on a measured pressure differential across the choke assembly 206.

The assembly 200 may further include an upper seal 306*a* and a lower seal 306*b* positioned within the central flow passage 302 on opposing axial ends of the openings 204. The upper seal 306*a* interposes the body 202 and the flow closure member 304 when the assembly 200 is in the maximal and minimal conditions. The lower seal 306*b*, however, interposes the body 202 and the flow closure member 304 only when the assembly 200 is in the fully closed position (i.e., minimal flow condition), as shown in FIG. 3A. When in radial contact with the flow closure member 304, the upper and lower seals 306*a,b* operate to sealingly engage the flow closure member 304 such that fluid migration past the upper and lower seals 306*a,b* in either axial direction is substantially prevented. Accordingly, when the flow closure member 304 is in the fully closed position, as shown in FIG. 3A, fluid migration into or out of the assembly 200 via the openings 204 may be substantially prevented.

In some embodiments, one or both of the upper and lower seals 306*a,b* may be characterized as a dynamic seal. The term "dynamic seal," as used herein, refers to a seal that provides pressure and/or fluid isolation between members that have relative displacement there between, for example, a seal that seals against a displacing surface, or a seal carried on one member and sealing against the other member. The upper and lower seals 306*a,b* may be made of a variety of materials including, but not limited to, an elastomer, a metal, a composite, a rubber, a ceramic, a thermoplastic, any derivative thereof, and any combination thereof. In at least one embodiment, one or both of the upper and lower seals 306*a,b* may form a metal-to-metal seal against the outer surface of the flow closure member 304.

The choke assembly 206 may also include a cylindrical flow trim 308 positioned within the central flow passage 302 and extending axially between the upper and lower seals 306*a,b*. The flow trim 308 may define and otherwise provide one or more flow orifices 310 that extend through the wall of the flow trim 308 and thereby facilitate fluid communication radially through the flow trim 308 when exposed. As described below, each flow orifice 310 may comprise a slot that extends helically about the circumference of the flow trim 308. When the flow trim 308 is installed in the assembly 200, at least a portion of the flow orifices 310 may generally align with the openings 204 defined in the body 202, and thereby enable fluid flow through the choke assembly 206 either into or out of the assembly 200.

When the assembly 200 is in the minimal flow condition, as shown in FIG. 3A, the upper and lower seals 306*a,b* operate to sealingly engage the outer surface of the flow closure member 304 and thereby substantially prevent fluid communication between the central flow passage 302 and the exterior of the body 202 via the openings 204. In some embodiments, the flow closure member 304 may include a nose 312 disposed at and otherwise coupled to an axial end of the flow closure member 304. In such embodiments, the lower seal 306*b* may sealingly engage the outer surface of the nose 312 when the assembly 200 is in the closed position. Similar to the flow trim 308, the nose 312 may be made of an erosion-resistant material, such as any of the erosion-resistant materials mentioned herein with respect to the flow trim 308.

When it is desired to commence production or injection operations using the assembly 200, the flow closure member 304 may be actuated to initiate movement from the closed position (FIG. 3A) to the open position (FIG. 3C) in a first direction, as indicated by the arrow A. In other embodiments, the flow closure member 304 may be actuated (moved) in a direction opposite the first direction A to move the flow closure member 304 to the open position. For purposes of the present discussion, it will be assumed that production operations will be undertaken with the assembly 200, where fluids originating from a surrounding subterranean formation (e.g., the formation 110 of FIG. 1) are to be drawn into the central flow passage 302 to be produced to a well surface for processing.

FIG. 3B shows the flow closure member 304 at an intermediate location between the closed and open positions. As the flow closure member 304 moves toward the open position in the first direction A, the openings 204 and the flow orifices 310 become progressively exposed and fluid is able to traverse the choke assembly 206 and enter the central flow passage 302 by flowing through the flow orifice(s) 310. The fluid drawn into the central flow passage 302 may exhibit immense flow rates and pressure. Sand particles and other debris entrained in the fluid traversing the choke assembly 206 will flow through the flow orifices 310 and directly impact the flow closure member 304 and, more particularly, the nose 312. Since the nose 312 is made of an erosion-resistant material, erosion or abrasion of the nose 312 due to the particulate laden fluid impinging upon the nose 312 may be minimal. However, it is not uncommon to maintain the flow closure member 304 at the intermediate location for long periods of time and thereby "choke" the fluid flow entering the body 202. Consequently, erosion or abrasion to the nose 312 may occur over time.

FIG. 3C shows the flow closure member 304 in the maximal flow condition (i.e., "fully open" operational condition). In accordance with the present disclosure, the shape and design of the flow orifice(s) 310 operate to minimize the erosion or abrasion experienced or assumed by the flow closure member 304 (e.g., the nose 312). More particularly, since the flow orifice(s) 310 are helical in shape, as the flow closure member 304 progressively moves toward the maximal flow condition in the first direction A, the fluid flowing through the flow orifice(s) 310 will progressively impinge on different angular locations along the circumference (perimeter) of the flow closure member 304 (e.g., the nose 312). As a result, any erosion or abrasion to the flow closure member 304 will occur progressively along the outer perimeter of the nose 312 as the flow closure member 304 moves axially within the central flow passage 302. Said differently, the point of impingement of the fluid flowing through the helically-shaped flow orifice(s) 310 will continuously move angularly about the circumference of the nose 312 as the flow closure member 304 moves axially in the first direction A. This may prove advantageous since the flow closure member 304 (i.e., the nose 312) is used to provide a sealing engagement against the lower seal 306*b*, and spreading potential erosion along the circumference of the nose 312, as opposed to erosion occurring at static angular locations, may prolong the useful life of the flow closure member 304.

Accordingly, the flow closure member 304 may be axially movable to throttle or "choke" the fluid flow through the choke assembly 206, and thereby intelligently regulate the flow rate into or out of the assembly 200. Moving the flow closure member 304 toward the maximal flow condition (open position) progressively exposes the flow orifice(s) 310 and thereby increases the fluid flow potential into or out of the assembly 200. In contrast, moving the flow closure member 304 toward the minimal flow condition (closed position) progressively occludes the flow orifice(s) 310 and thereby decreases the fluid flow potential into or out of the assembly 200.

Figure 4A:
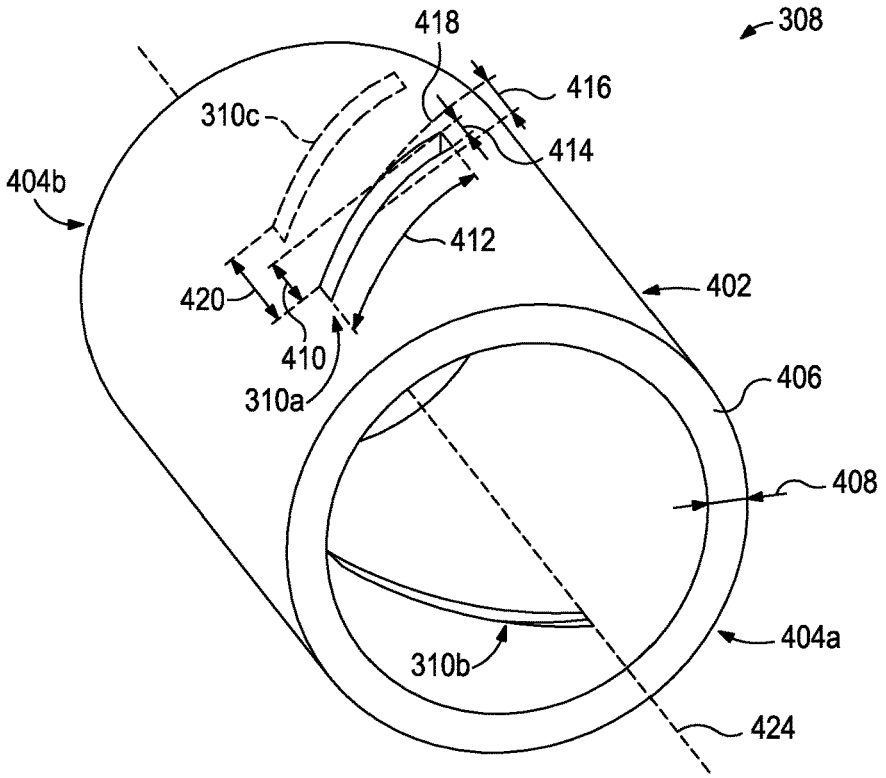
FIGS. 4A and 4B are isometric and cross-sectional side views, respectively, of an example embodiment of the flow trim of FIGS. 3A-3C.
Figure 4B:
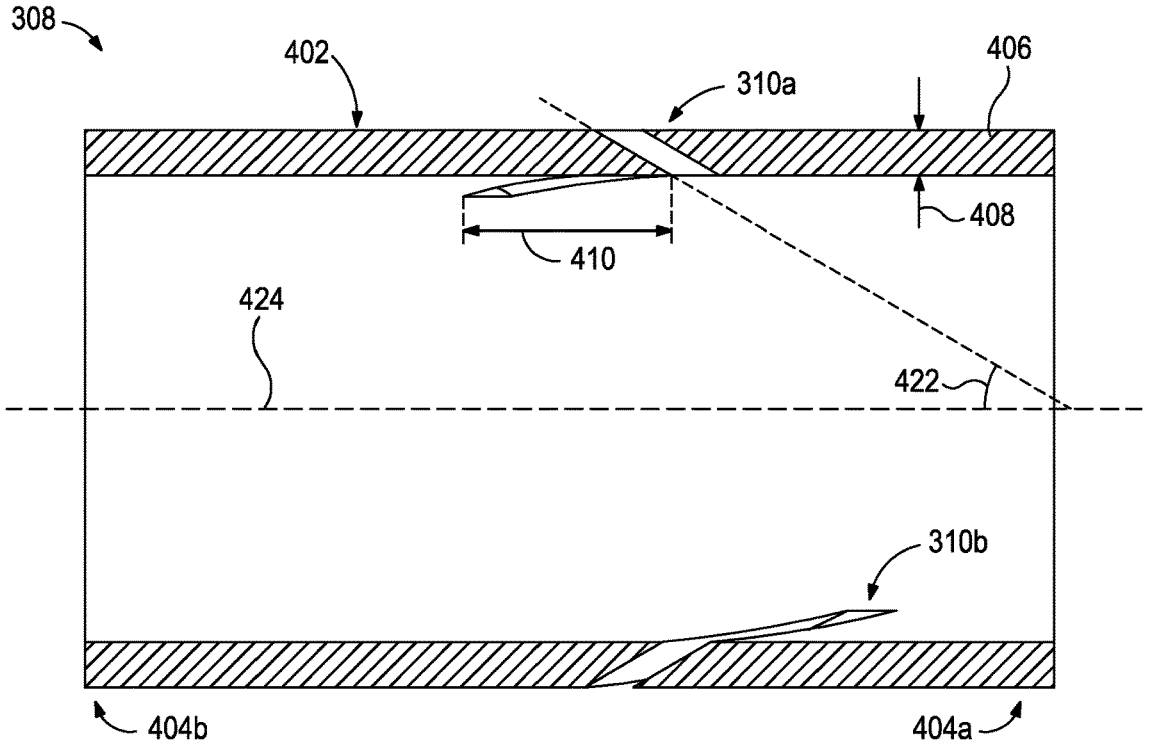

FIGS. 4A and 4B are isometric and cross-sectional side views, respectively, of an example embodiment of the flow trim 308 of FIGS. 3A and 3B, according to one or more embodiments. As illustrated, the flow trim 308 may comprise a cylindrical body 402 having a first end 404*a* and a second end 404*b* opposite the first end 404*a*. The body 402 provides an annular wall 406 that exhibits a wall thickness 408 largely dependent on the design of the particular flow control assembly (e.g., the assembly 200 of FIGS. 2 and 3A-3B) in which the flow trim 308 is to be deployed. In some embodiments, as illustrated, the wall thickness 408 may be constant between the first and second ends 404*a,b*. In other embodiments, however, the wall thickness 408 may vary between the first and second ends 404*a,b*, without departing from the scope of the disclosure.

In some embodiments, the flow trim 308 may be made of an erosion-resistant material such as, but not limited to, a carbide grade (e.g., tungsten, titanium, tantalum, vanadium, etc.), a carbide embedded in a matrix of cobalt or nickel by sintering, a ceramic, a surface hardened metal (e.g., nitrided metals, heat-treated metals, carburized metals, etc.), a surface coated metal, a cermet-based material, a metal matrix composite, a nanocrystalline metallic alloy, an amorphous alloy, a hard metallic alloy, diamond, or any combination thereof. As made of an erosion-resistant material, the flow trim 308 may be able to better withstand the erosive effect resulting from sand particles and other debris entrained in fluid flow streams traversing the choke assembly 206 during operation. In at least one embodiment, the body of the flow trim 308 may be made of a first material, and the material around and encompassing the flow orifices 310 may comprise a second material. In such embodiments, for instance, the first material may comprise a material that is generally impact and stress resistant, while the second material may comprise an erosion-resistant material.

Two flow orifices 310, shown as a first flow orifice 310*a* and a second flow orifice 310*b*, are depicted in FIGS. 4A and 4B and are defined through the annular wall 406 of the body 402. While two flow orifices 310*a,b* are illustrated, more or less than two flow orifices 310*a,b* may be provided in the body 402, without departing from the scope of the disclosure. In some embodiments, as indicated above, each flow orifice 310*a,b* may be configured to coincide and otherwise align with a corresponding one of the openings 204 defined in the body 202 (FIGS. 2 and 3A-3B). Accordingly, in some cases, the number of flow orifices 310*a,b* and openings 204 may be equal. In the illustrated embodiment, the two flow orifices 310*a,b* are angularly offset from each other about the circumference of the body 402 by 180°, but could alternatively be angularly offset from each other by any angular magnitude (distance). In embodiments where there are more than two flow orifices 310*a,b*, such as three, the three flow orifices may be angularly offset from each other by about 120°, or by any desired angular magnitude.

Each flow orifice 310*a,b* may comprise a slot formed or otherwise defined entirely through the annular wall 406 and extending about the circumference of the body 402 in the general shape of a helix or a spiral. Accordingly, in at least one embodiment, the flow orifice(s) 310*a,b* may be characterized as "helical" flow orifices 310*a,b*. As shown in FIG. 4A, for example, the first flow orifice 310*a* extends an axial distance 410 between the first and second ends 404*a,b* while simultaneously extending an angular length 412 about the circumference of the body 402. When both the axial distance 410 and the angular length 412 are greater than zero, the first flow orifice 310*a* will be generally defined as a helix, or otherwise in the general shape of a spiral about the body 402. The axial distance 410 and the angular length 412 are not limited to any distances or ranges, but instead may vary depending on the application.

The first flow orifice 310*a* (and/or the second flow orifice 310*b*) may also exhibit a width 414. As used herein, the term "width" as used in conjunction with the width of a given flow orifice refers to an axial depth measurement of the given flow orifice between the first and second ends 404*a,b* of the body 402 at any angular location along the angular length 412. In some embodiments, as illustrated, the width 414 of the first flow orifice 310*a* may be constant along the angular length 412. In other embodiments, however, the width 414 of the first flow orifice 310*a* may vary along the angular length 412. For instance, in at least one embodiment, the width 414 of the first flow orifice 310*a* may increase along the angular length 412 to a second, larger width 416, as indicated by the phantom lines 418. The increase to the second width 416 from the first width 414, as illustrated, may be gradual. In other embodiments, however, the increase to the second width 416 from the first width 414 may be stepped (abrupt), such as according to a step function, or may alternatively by variable, such as undulating or according to a polynomial function, or any combination thereof.

While the first and second flow orifices 310*a,b* are depicted as being angularly offset from each other by about 180°, in some embodiments, the flow trim 308 may include one or more flow orifices that are instead axially offset from each other and possibly angularly overlapping each other over at least some angular distance. In the illustrated example, for instance, a third flow orifice 310*c* is shown in phantom and axially separated from the first flow orifice 310*a* by a second axial distance 420. The second axial distance 420 is not limited to any range or magnitude, but may instead vary depending on the requirements of a particular application. Moreover, the third flow orifice 310*c* is depicted as being generally parallel (both axially and angularly) to the first flow orifice 310*a* and extending substantially the same angular length 412. In other embodiments, however, the first and third flow orifices 310*a,c* may be non-parallel, they may exhibit different angular lengths 412, and/or they may angularly overlap each other as viewed axially, without departing from the scope of the disclosure. In yet other embodiments, the first and third flow orifices 310*a,c* may angularly and axially overlap each other. In even further embodiments, the helical flow orifices 310*a-c* may be combined in any configuration with one or more non-helical flow orifices (not shown), without departing from the scope of the disclosure.

Referring specifically to FIG. 4B, in some embodiments, one or both of the first and second flow orifices 310*a,b* may be defined through the annular wall at an angle 422 offset from a longitudinal axis 424 of the flow trim 308. The magnitude of the angle 422 can range anywhere from above 0° to 180°. The angle 422 will dictate the angle of impingement that fluids flowing into the assembly 200 (FIGS. 2 and 3A-3B) via the openings 204 (FIGS. 2 and 3A-3B) and the flow trim 308 will impinge upon the flow closure member 304 (FIGS. 3A-3B) and potentially cause erosion. As the magnitude of the angle 422 approaches 90°, the potential for erosion of the flow closure member 304 correspondingly increases. In contrast, as the magnitude of the angle 422 gets closer to the longitudinal axis 424 and otherwise approaches 0° or 180° (i.e., more acute or more obtuse), the potential for erosion of the flow closure member 304 correspondingly decreases.

Figure 5:
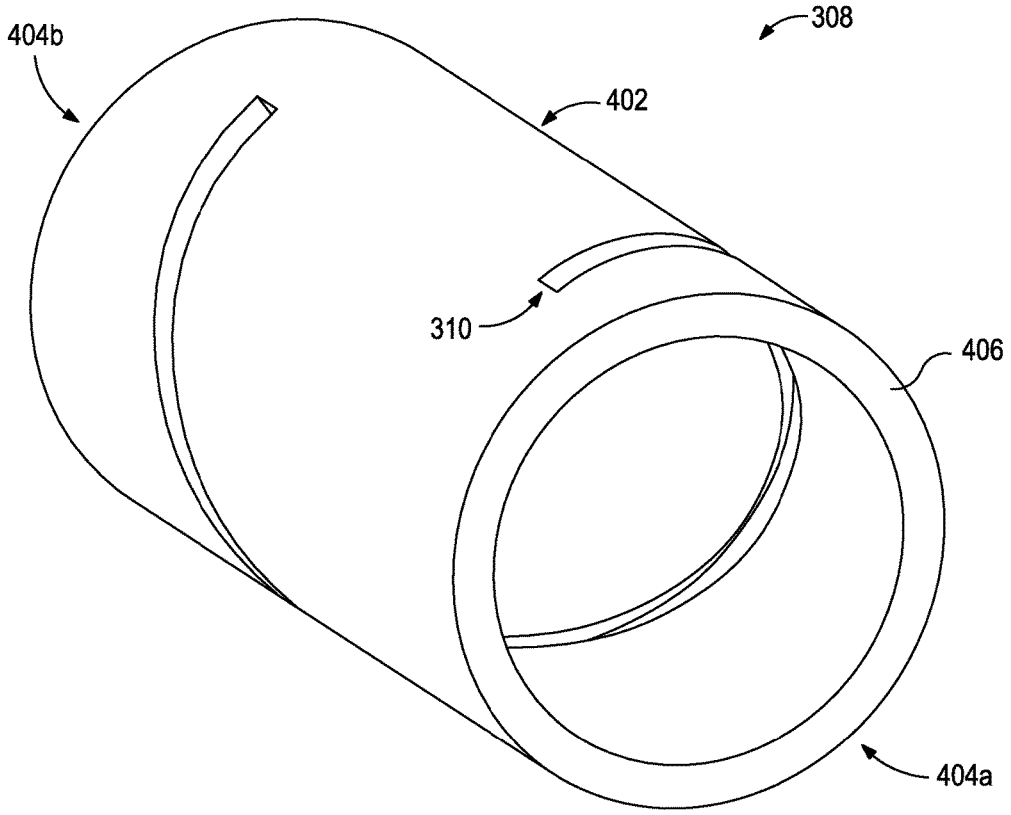
FIG. 5 is an isometric view of another example embodiment of the flow trim of FIGS. 3A-3C.

FIG. 5 is an isometric view of another example embodiment of the flow trim 308 of FIGS. 3A and 3B. Similar to the embodiment shown in FIGS. 4A-4B, the flow trim 308 in FIG. 5 comprises the cylindrical body 402 having the first and second ends 404*a,b*. Unlike the embodiment shown in FIGS. 4A-4B, however, the flow trim 308 in FIG. 5 comprises a single flow orifice 310 defined through the annular wall 406 of the body 402. As illustrated, the flow orifice 310 defines a full helical revolution about the circumference of the body 402. Accordingly, the angular length 412 (FIG. 4A) of the depicted flow orifice 310 is 360° (2*n* radians). In other embodiments, the angular length 412 of the flow orifice 310 may be more or less than 360°, such as 180° (n radians) or extending two or more full revolutions, without departing from the scope of the disclosure. As with the embodiment shown in FIGS. 4A-4B, the flow orifice 310 in FIG. 5 may be defined through the annular wall 406 at the angle 422 (FIG. 4B), which can range anywhere from above 0° to 180°.

Moreover, since the flow orifice(s) 310 are defined through the annular wall 406 (FIGS. 4A-4B) at the angle 422 (FIGS. 4A-4B), the fluid flowing through the flow orifice(s) 310 will correspondingly impinge upon the flow closure member 304 (e.g., the nose 312) at the angle 422. As indicated above, a more acute (or more obtuse) angle 422 with respect to the longitudinal axis 424 (FIGS. 4A-4B) will decrease the potential for erosion of the flow closure member 304, while an angle 422 closer to 90° will increase the potential for erosion of the flow closure member 304. Accordingly, embodiments of the present disclosure may prove advantageous in having flow orifice(s) 310 with an angle 422 of impingement that minimizes erosion and/or abrasion to the flow closure member 304.

Figure 6A:
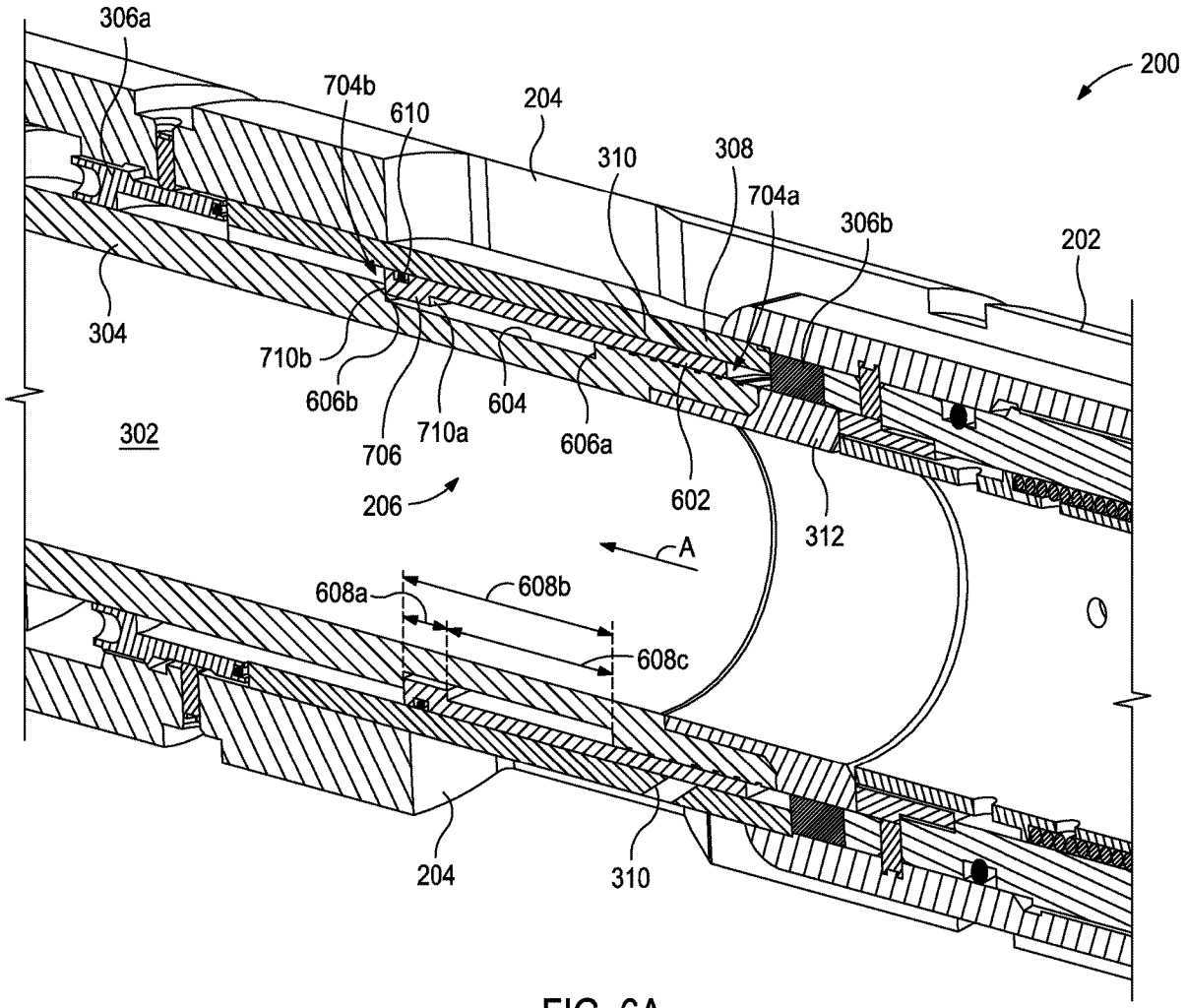
FIGS. 6A-6D are progressive isometric cross-sectional side views of another embodiment of the flow control assembly of FIG. 2.
Figure 6B:
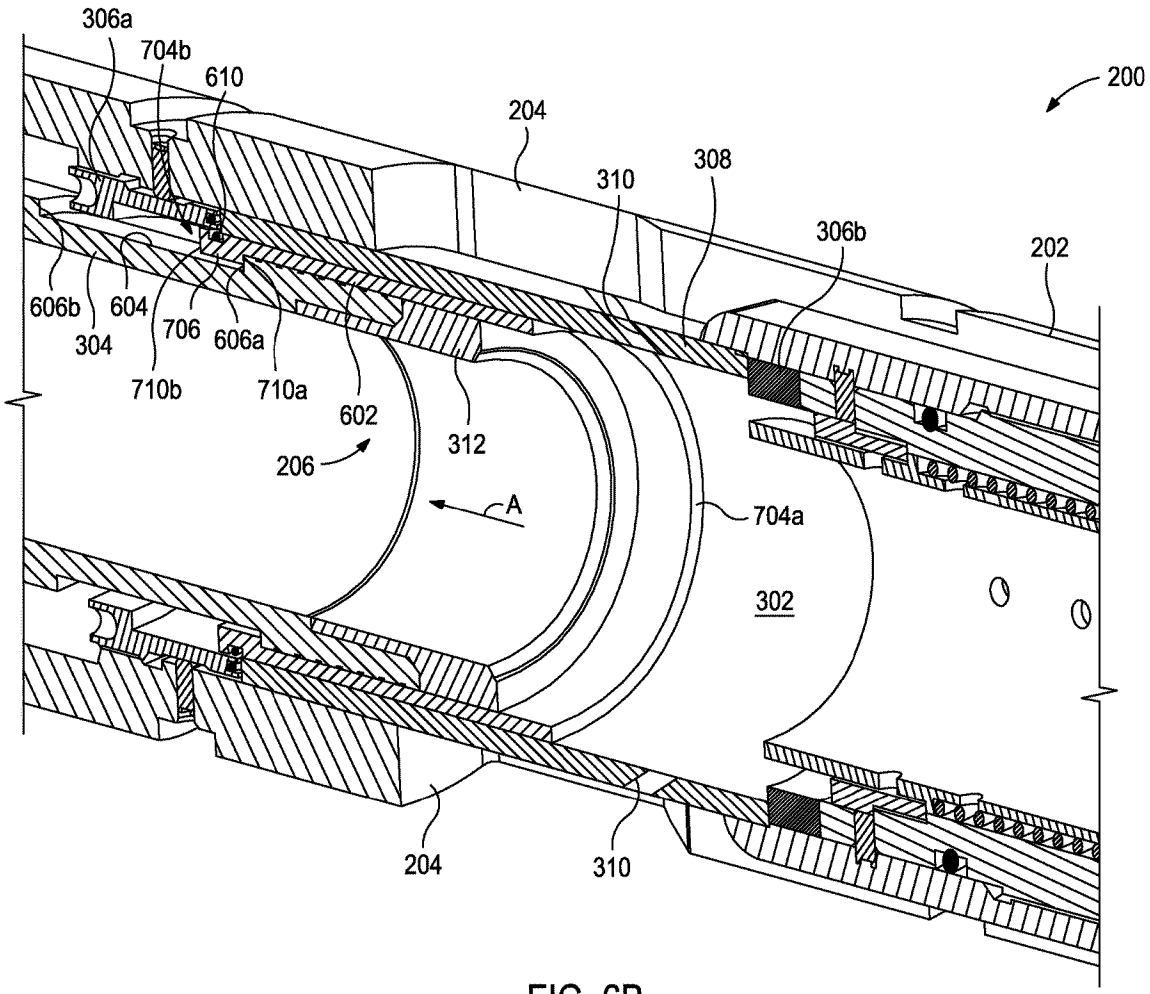
Figure 6C:
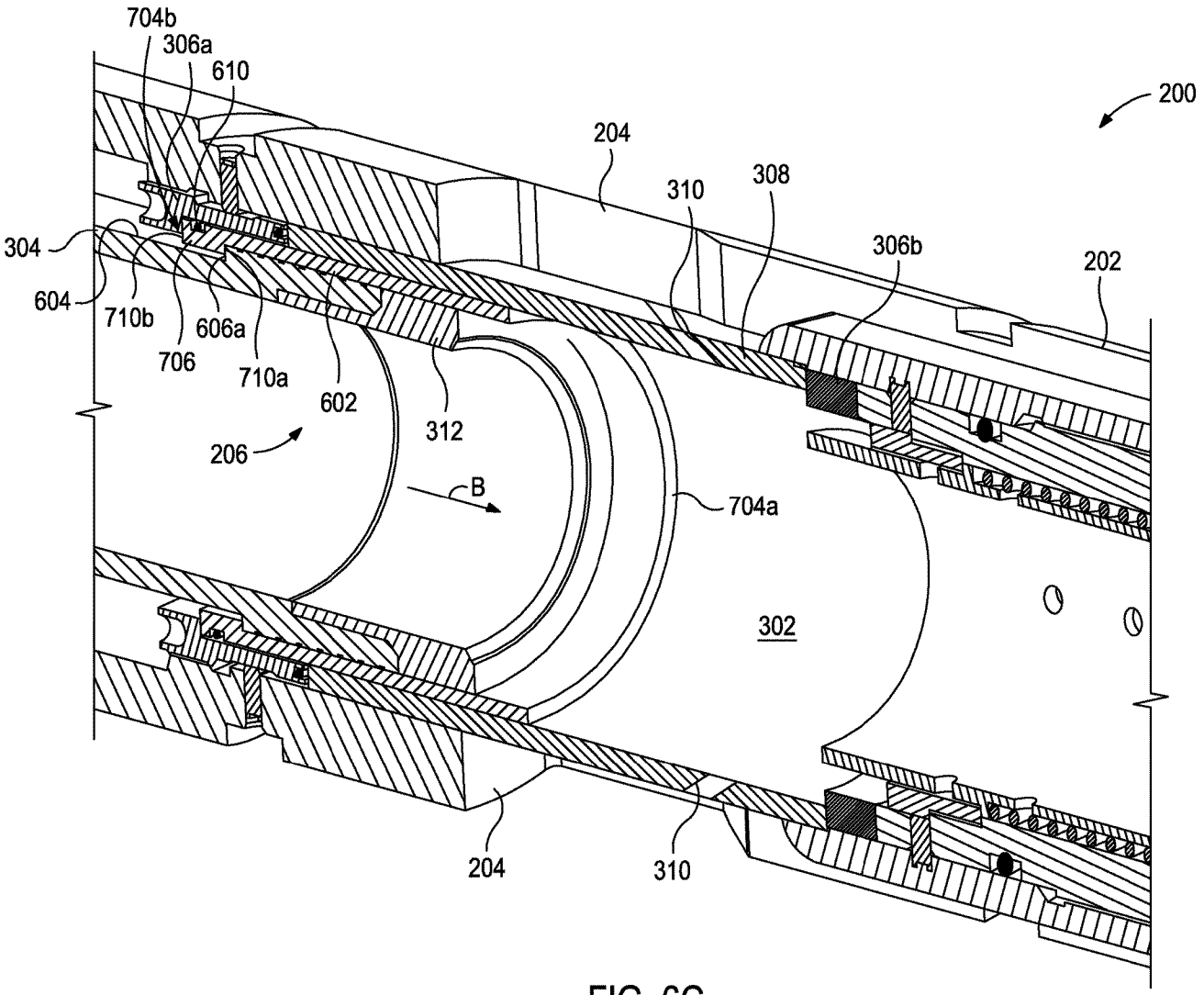
Figure 6D:
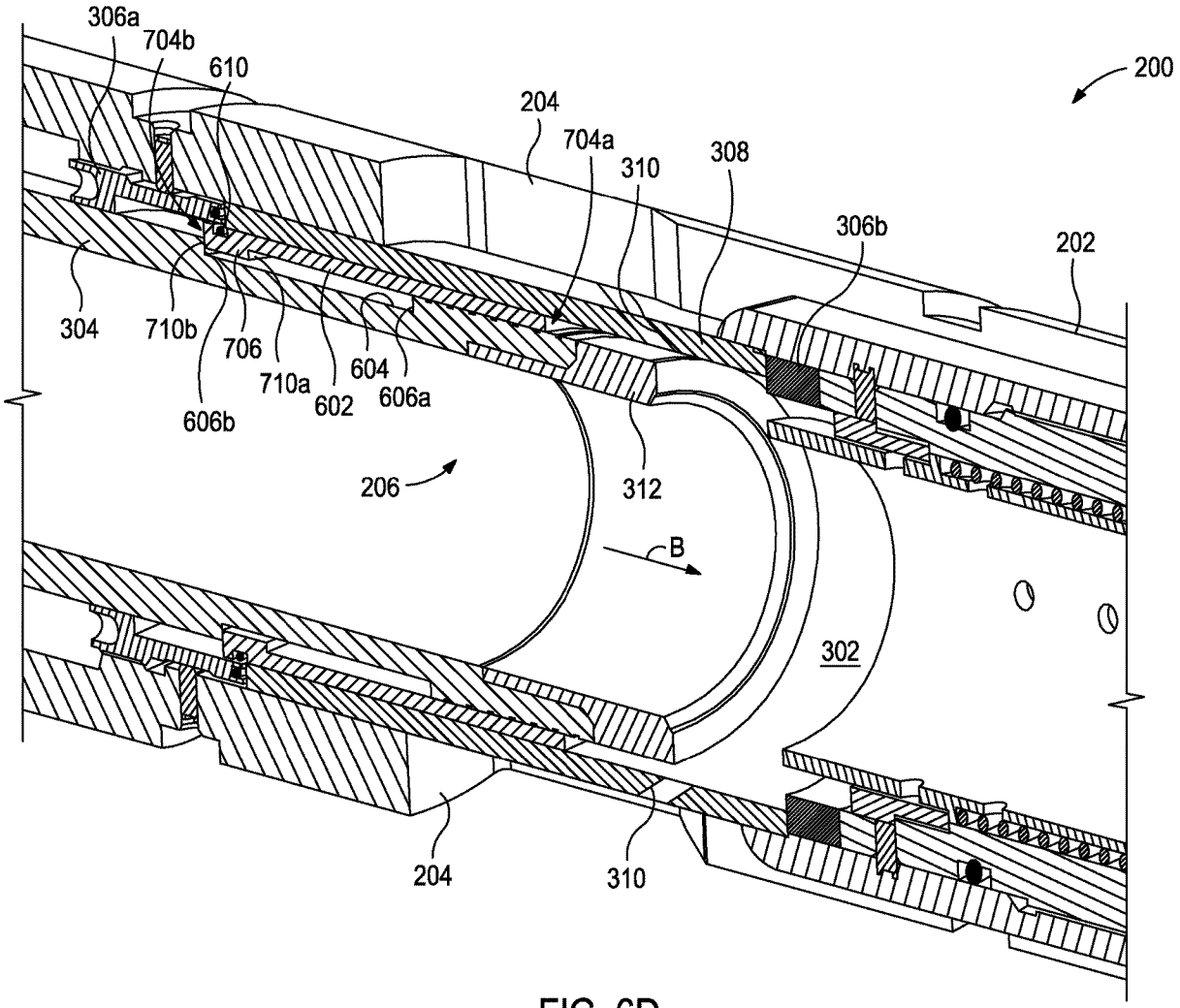

FIGS. 6A-6D are cross-sectional views of another embodiment of the assembly 200 of FIG. 2 in different operational conditions corresponding to different lateral flow restrictions by virtue of operating the choke assembly 206. More specifically, FIG. 6A depicts the assembly 200 in the fully closed position, or a minimal flow condition where the lateral flow openings 204 are occluded to provide minimal transverse flow. FIG. 6B depicts the assembly 200 at an intermediate location or "partially open" operational condition between the fully closed and open positions and moving to the fully open position and where the lateral flow openings 204 are less occluded than in FIG. 6A to allow appreciable transverse flow through the lateral flow openings 204. FIG. 6C depicts the assembly 200 in the fully open position, or a maximal flow condition corresponding to the most flow through the lateral flow openings 204 allowed by the choke assembly 206. Lastly, FIG. 6D depicts the assembly 200 at another intermediate location or "partially open" operational condition between the fully closed and open positions and moving to the fully closed position.

Similar to the embodiment of FIGS. 3A-3C, the assembly 200 depicted in FIG. 6A includes the body 202, the one or more openings 204 (two shown) defined in the body 202, and the choke assembly 206 disposed within the central flow passage 302 to regulate fluid flow into or out of the assembly 200. The choke assembly 206 includes the flow closure member 304 movably disposed within the central flow passage 302 and optionally including the nose 312 positioned at the axial end thereof, as generally described above. In the illustrated embodiment, the choke assembly 206 includes the flow trim 308 described herein, which provides the one or more helical flow orifices 310 (two shown). In other embodiments, however, the flow trim 308 may be replaced with another flow trim that exhibits an alternative design or configuration, but nonetheless includes one or more flow orifices that allow fluids to traverse the choke assembly 206 when not occluded by the flow closure member 304. Accordingly, the flow trim 308 as described herein is not required as part of the embodiment of the assembly 200 depicted in FIGS. 6A-6D.

Unlike the embodiment of FIGS. 3A-3C, however, the choke assembly 206 of FIG. 6A may further include a sacrificial nose 602 positioned to radially interpose the flow closure member 304 and the flow trim 308. As illustrated in FIG. 6A, the sacrificial nose 602 may comprise an annular structure that is at least partially movable with the flow closure member 304 between the closed and open positions. During operation of the assembly 200, the sacrificial nose 602 protects the flow closure member 304 from the erosive and/or abrasive effects of the solids-laden fluid traversing the choke assembly 206. Instead of the fluid traversing the choke assembly 206 and impinging on the flow closure member 304 (i.e., the nose 312) during fluid choking operations, the fluid will directly impinge upon and erode the sacrificial nose 602. Erosion of the flow closure member 304 (i.e., the nose 312) may adversely affect the sealing capability of the nose 312 against the lower seal 306*b*. Accordingly, the sacrificial nose 602 may prove advantageous in mitigating erosion of the nose 312 and thereby prolonging the useful life of the flow closure member 304.

Figure 7A:
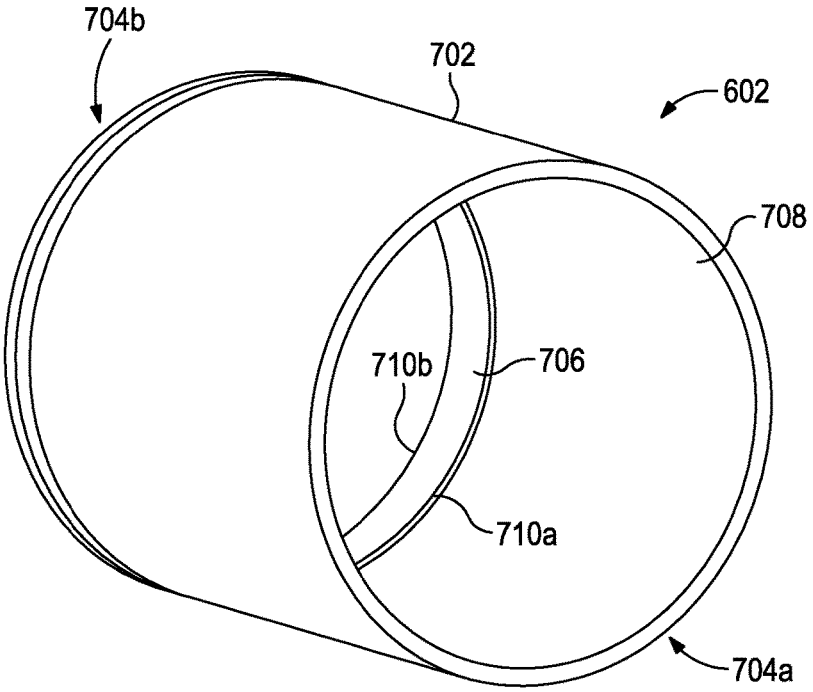
FIGS. 7A and 7B are isometric and cross-sectional side views, respectively, of an example embodiment of the sacrificial nose of FIGS. 6A-6D.
Figure 7B:
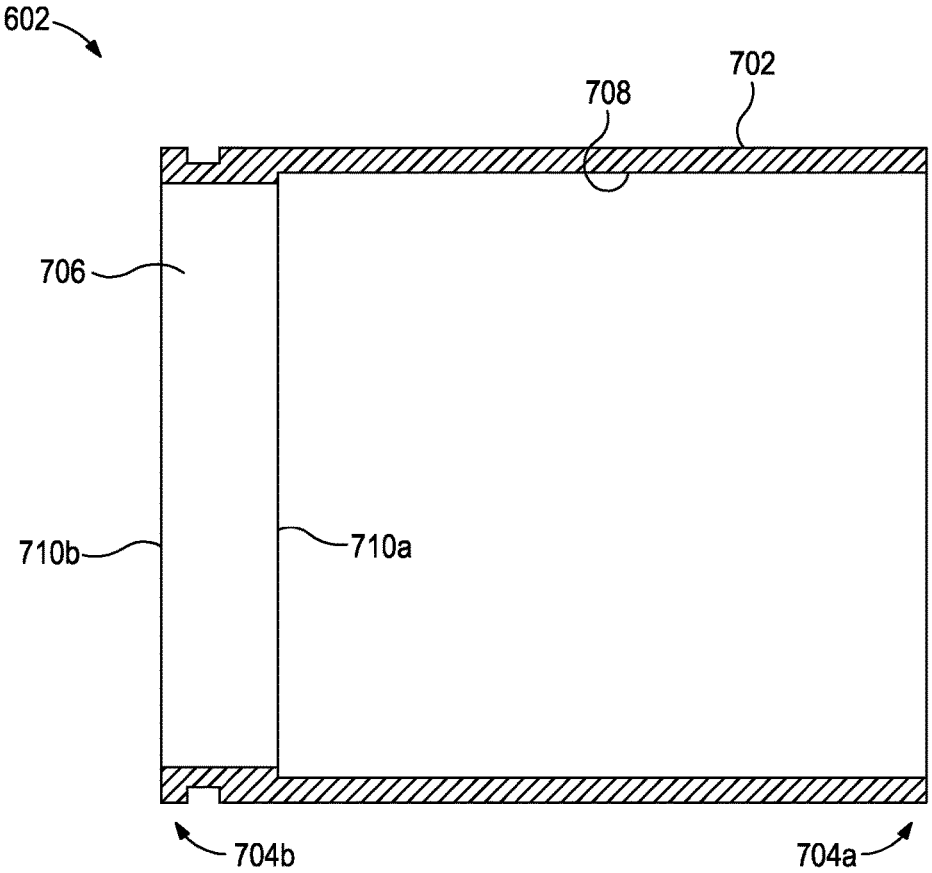

FIGS. 7A and 7B are isometric and cross-sectional side views, respectively, of an example embodiment of the sacrificial nose 602 of FIGS. 6A-6D, according to one or more embodiments. The sacrificial nose 602 may be made of an erosion-resistant material, such as any of the erosion-resistant materials mentioned herein with respect to the flow trim 308. As illustrated, the sacrificial nose 602 may comprise a cylindrical body 702 having a first end 704*a* and a second end 704*b* opposite the first end 704*a*. As illustrated, the sacrificial nose 602 may include and otherwise define a radial projection 706 at or near the second end 704*b* and extending radially inward from the inner surface 708 of the body 702. The radial projection 706 may provide a first or leading shoulder 710*a* and a second or trailing shoulder 710*b* opposite the leading shoulder 710*a*.

Referring again to FIG. 6A, the radial projection 706 may be configured to extend radially into an annular channel 604 defined by the flow closure member 304 and providing a first axial end 606*a* and a second axial end 606*b*. The radial projection 706 may exhibit a first axial length 608*a* while the annular channel 604 may exhibit a second axial length 608*b* that is greater than the first axial length 608*a*, and thereby providing an axial gap 608*c*. As illustrated, the axial gap 608*c* may be formed between the first axial end 606*a* and the leading shoulder 710*a* when the second axial end 606*b* and the trailing shoulder 710*b* are axially engaged, and may alternatively be formed between the second axial end 606*b* and the trailing shoulder 710*b* when the first axial end 606*a* and the leading shoulder 710*a* are axially engaged. As described below, the flow closure member 304 may be axially displaceable with respect to the sacrificial nose 602 and, as a result, the radial projection 706 may be displaceable axially within the annular channel 604 between the first and second ends 606*a,b* and thereby alter the magnitude of the axial gap 608*c* as the flow closure member 304 moves between the closed and open positions.

Example operation of the assembly 200 is now provided in moving the flow closure member 304 from the closed position (FIG. 6A), to the open position (FIG. 6C), and back to the closed position (FIG. 6D). When the assembly 200 is in the closed position, as shown in FIG. 6A, the upper and lower seals 306*a,b* sealingly engage the outer surface of the flow closure member 304 (i.e., the nose 312). When it is desired to commence production or injection operations using the assembly 200, the flow closure member 304 may be actuated to commence movement from the closed position to the open position in the first direction A. In other embodiments, the flow closure member 304 may alternatively be actuated (moved) in a direction opposite the first direction A to move the flow closure member 304 to the open position. For purposes of the present discussion, it will be assumed that production operations will be undertaken, where fluids originating from a surrounding subterranean formation 110 (FIG. 1) are to be drawn into the central flow passage 302 to be produced to a well surface for processing.

FIG. 6B shows the flow closure member 304 at an intermediate location between the closed and open positions. As the flow closure member 304 commences movement toward the open position, the sacrificial nose 602 may remain stationary with respect to the flow trim 308. More particularly, the sacrificial nose 602 may include a friction element 610 that interposes the sacrificial nose 602 and the flow trim 308 at or near the second end 704*b*. The friction element 610 may be configured to generate and maintain an amount friction force between the sacrificial nose 602 and the flow trim 308 such that the sacrificial nose 602 remains stationary with respect to the flow trim 308 until the friction force is overcome. In some embodiments, as illustrated, the friction element 610 may comprise an O-ring or another type of sealing element. In other embodiments, however, the friction element 610 may comprise a plastic element, such as PEEK, or a metal element, such as a metal spring.

The flow closure member 304 may move axially in the first direction A with respect to the sacrificial nose 602 until the first end 606*a* of the annular channel 604 axially engages the leading shoulder 710*a* of the sacrificial nose 602. With the first end 606*a* and the leading shoulder 710*a* axially engaged, the flow closure member 304 is moved with respect to the sacrificial nose 602 such that the nose 312 is entirely received within the sacrificial nose 602 and the first end 704*a* of the sacrificial nose 602 otherwise extends axially past the axial end of the flow closure member 304. Further movement of the flow closure member 304 in the first direction A will overcome the friction force of the friction element 610, and thereby correspondingly move the sacrificial nose 602 in the first direction A.

As the flow closure member 304 and the sacrificial nose 602 move axially in the first direction A, the openings 204 and the flow orifices 310 become progressively exposed and fluid is able to traverse the choke assembly 206 and enter the central flow passage 302. As indicated above, it is not uncommon to maintain the flow closure member 304 at an intermediate location for long periods of time and thereby "choke" the fluid flow entering the body 202. However, since the end of the flow closure member 304 is received within the sacrificial nose 602 and otherwise does not extend out of the sacrificial nose 602, the solids-laden fluid flowing through the openings 204 and the flow orifice(s) 310 will impinge on the sacrificial nose 602. As a result, any erosion or abrasion assumed by the choke assembly 206 as the flow closure member 304 moves toward the fully open position or is maintained in the intermediate location will occur on the sacrificial nose 602 instead of on the nose 312 or any other part of the flow closure member 304. Consequently, the sealing surfaces of the flow closure member 304 (i.e., the nose 312) will be protected from erosion and/or abrasion.

FIG. 6C shows the assembly 200 in the fully open position. During production operations, the flow trim 308 and/or the sacrificial nose 602 will assume erosive or abrasive wear caused by the inflowing fluid into the central flow passage 302 via the openings 204 and the flow orifice(s) 310, while the flow closure member 304, including the nose 312, will be largely unaffected. When it is desired to stop production operations or otherwise "choke" (reduce) the fluid flow into the central flow passage 302, the flow closure member 304 may be actuated to initiate movement in a second direction, as indicated by the arrow B, where the second direction B is opposite the first direction A (FIGS. 6A-6B).

FIG. 6D shows the flow closure member 304 at an intermediate location as moving between the open and closed positions. As the flow closure member 304 commences movement toward the closed position, the friction element 610 may again operate to maintain the sacrificial nose 602 stationary with respect to the flow trim 308 until engaged by the flow closure member 304. More particularly, the flow closure member 304 may move axially in the second direction B with respect to the sacrificial nose 602 until the second end 606*b* of the annular channel 604 axially engages the trailing shoulder 710*b* of the sacrificial nose 602. As shown in FIG. 6D, moving the flow closure member 304 until the second end 606*b* axially engages the trailing shoulder 710*b* will correspondingly move the flow closure member 304 with respect to the sacrificial nose 602 such that the flow closure member 304 (i.e., the nose 312) extends out of the sacrificial nose 602 and becomes exposed to any incoming fluids via the openings 204 and the flow orifice(s) 310. Further movement of the flow closure member 304 in the second direction B will overcome the friction force of the friction element 610, and thereby correspondingly move the sacrificial nose 602 in the second direction B and toward the fully closed position (i.e., minimal flow condition), as shown in FIG. 6A.

As the flow closure member 304 and the sacrificial nose 602 move axially in the second direction B, the openings 204 and the flow orifice(s) 310 become progressively occluded and the incoming fluid flow is correspondingly choked (reduced). Moreover, since the end of the flow closure member 304 is extended out of the sacrificial nose 602 and otherwise exposed, the solids-laden fluid flowing through the openings 204 and the flow orifice(s) 310 will impinge flow closure member 304 (i.e., the nose 312) as the assembly 200 is actuated back to the closed position. While the flow closure member 304 (i.e., the nose 312) may be subjected to fluid erosion and/or abrasion as the assembly 200 moves toward the closed position, this movement is typically done quickly such that any damage to the flow closure member 304 will generally be minimal.

In some embodiments, a flow control assembly according to the principles of the present disclosure includes a cylindrical body defining an central flow passage and one or more openings that facilitate fluid communication between the central flow passage and an exterior of the body, and a flow trim positioned within the central flow passage and defining one or more flow orifices extending helically about a circumference of the flow trim and aligned with the one or more openings. The flow control assembly also includes a flow closure member positioned within the central flow passage and movable between a closed position, where the one or more openings and the one or more flow orifices are occluded to prevent fluid flow through the one or more openings, and an open position, where the one or more openings and the one or more flow orifices are at least partially exposed to facilitate fluid flow through the one or more openings.

The flow trim may comprise an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof.

A width of at least one of the one or more flow orifices may vary along an angular length of the at least one of the one or more flow orifices.

The flow trim may include an annular wall and each flow orifice may be defined through the annular wall at an angle offset from a longitudinal axis of the flow trim.

At least one of the one or more flow orifices defines a full helical revolution about the circumference of the flow trim.

The one or more flow orifices may include at least two flow orifices axially offset from each other along a longitudinal axis of the flow trim. The at least two flow orifices may be parallel to each other.

The one or more flow orifices may include at least two flow orifices angularly offset from each other by 180°.

The flow closure member may be selected from the group consisting of a sliding sleeve, a rotating sleeve, a sliding plug, a rotating ball, an oscillating vane, an opening pocket, an opening window, a valve, and any combination thereof.

In some embodiments, a well system according to the principles of the present disclosure may include a tubing string extendable within a wellbore, and at least one flow control assembly coupled to the tubing string. The flow control assembly may include a cylindrical body defining a central flow passage and one or more openings that facilitate fluid communication between the central flow passage and the wellbore, wherein the central flow passage is in fluid communication with the tubing string, and a flow trim positioned within the central flow passage and defining one or more flow orifices extending helically about a circumference of the flow trim and aligned with the one or more openings. The flow control assembly may further include a flow closure member positioned within the central flow passage and movable between a closed position, where the one or more openings and the one or more flow orifices are occluded to prevent fluid flow through the one or more openings, and an open position, where the one or more openings and the one or more flow orifices are at least partially exposed to facilitate fluid flow through the one or more openings.

The flow trim may include an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof.

The flow trim may include an annular wall and each flow orifice may be defined through the annular wall at an angle offset from a longitudinal axis of the flow trim.

The flow closure member may be selected from the group consisting of a sliding sleeve, a rotating sleeve, a sliding plug, a rotating ball, an oscillating vane, an opening pocket, an opening window, a valve, and any combination thereof.

A width of at least one of the one or more flow orifices may vary along an angular length of the at least one of the one or more flow orifices.

The one or more flow orifices may include at least two flow orifices axially offset from each other along a longitudinal axis of the flow trim.

The one or more flow orifices may include at least two flow orifices angularly offset from each other.

In some embodiments, a method according to the principles of the present disclosure may include introducing a tubing string into a wellbore, the tubing string having at least one flow control assembly coupled thereto and including a cylindrical body defining one or more openings that facilitate fluid communication between a central flow passage and the wellbore, wherein the central flow passage is in fluid communication with the tubing string. The at least one flow control assembly may further include a flow trim positioned within the central flow passage and defining one or more flow orifices radially extending helically about a circumference of the flow trim and aligned with the one or more openings. The at least one flow control assembly may also include a flow closure member movably positioned within the body. The method may further include actuating the flow closure member to regulate a flow of a fluid through the one or more openings.

Actuating the flow closure member may include moving the flow closure member from a closed position, where the one or more openings and the one or more flow orifices are occluded and prevent the fluid from flowing through the one or more flow openings, toward an open position, where the one or more openings and the one or more flow orifices become progressively exposed to allow the fluid to flow through the one or more openings. Actuating the flow closure member may also include impinging the fluid against the flow closure member at progressively different angular locations along a circumference of the flow closure member as the flow closure member moves toward the open position.

The flow trim may include an annular wall and each flow orifice may be defined entirely through the annular wall at an angle offset from a longitudinal axis of the flow trim. The method may further include mitigating erosion of the flow closure member by impinging the fluid against the flow closure member at the angle.

Embodiments disclosed herein include:

A. A flow control assembly that includes a cylindrical body defining an central flow passage and one or more openings that facilitate fluid communication between the central flow passage and an exterior of the body, a flow trim positioned within the central flow passage and defining one or more flow orifices aligned with the one or more openings, a flow closure member positioned within the central flow passage and movable between a closed position, where the one or more openings and the one or more flow orifices are occluded to prevent fluid flow through the one or more openings, and an open position, where the one or more openings and the one or more flow orifices are at least partially exposed to facilitate fluid flow through the one or more openings, and a sacrificial nose radially interposing the flow closure member and the flow trim to mitigate erosion of the flow closure member.

B. A well system that includes a tubing string extendable within a wellbore, at least one flow control assembly coupled to the tubing string and including a cylindrical body defining an central flow passage and one or more openings that facilitate fluid communication between the central flow passage and an exterior of the body, wherein the central flow passage is in fluid communication with the tubing string, a flow trim positioned within the central flow passage and defining one or more flow orifices aligned with the one or more openings, a flow closure member positioned within the central flow passage and movable between a closed position, where the one or more openings and the one or more flow orifices are occluded to prevent fluid flow through the one or more openings, and an open position, where the one or more openings and the one or more flow orifices are at least partially exposed to facilitate fluid flow through the one or more openings, and a sacrificial nose radially interposing the flow closure member and the flow trim to mitigate erosion of the flow closure member.

C. A method that includes introducing a tubing string into a wellbore, the tubing string having at least one flow control assembly coupled thereto and the at least one flow control assembly including a cylindrical body defining one or more openings that facilitate fluid communication between a central flow passage and the wellbore, wherein the central flow passage is in fluid communication with the tubing string, a flow trim positioned within the central flow passage and defining one or more flow orifices aligned with the one or more openings, a flow closure member movably positioned within the body, and a sacrificial nose radially interposing the flow closure member and the flow trim. The method further including actuating the flow closure member to regulate a flow of a fluid through the one or more openings, and mitigating erosion of the flow closure member caused by the fluid with the sacrificial nose.

Each of embodiments A, B, and C may have one or more of the following additional elements in any combination: Element 1: wherein the sacrificial nose comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof. Element 2: further comprising an annular channel defined on an outer surface of the flow closure member and providing a first axial end and a second axial end opposite the first axial end, and a radial projection extending radially inward from the sacrificial nose and received within the annular channel, the radial projection providing a first shoulder and a second shoulder opposite the first shoulder. Element 3: wherein the radial projection exhibits a first axial length and the annular channel exhibits a second axial length greater than the first axial length such that an axial gap is formed between the first axial end and the first shoulder when the second axial end and the second shoulder are axially engaged, and such that the axial gap is alternatively formed between the second axial end and the second shoulder when the first axial end and the first shoulder are axially engaged. Element 4: wherein the flow closure member is axially displaceable with respect to the sacrificial nose to axially displace the radial projection within the annular channel between the first and second ends. Element 5: wherein the flow closure member is selected from the group consisting of a sliding sleeve, a rotating sleeve, a sliding plug, a rotating ball, an oscillating vane, an opening pocket, an opening window, a valve, and any combination thereof. Element 6: wherein the one or more flow orifices extend helically about a circumference of the flow trim. Element 7: wherein the flow trim comprises an annular wall and each flow orifice is defined through the annular wall at an angle offset from a longitudinal axis of the flow trim. Element 8: wherein a width of at least one of the one or more flow orifices varies along an angular length of the at least one of the one or more flow orifices.

Element 9: wherein the sacrificial nose comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof. Element 10: further comprising an annular channel defined on an outer surface of the flow closure member and providing a first axial end and a second axial end opposite the first axial end, and a radial projection extending radially inward from the sacrificial nose and received within the annular channel, the radial projection providing a first shoulder and a second shoulder opposite the first shoulder. Element 11: wherein the radial projection exhibits a first axial length and the annular channel exhibits a second axial length greater than the first axial length such that an axial gap is formed between the first axial end and the first shoulder when the second axial end and the second shoulder are axially engaged, and such that the axial gap is alternatively formed between the second axial end and the second shoulder when the first axial end and the first shoulder are axially engaged. Element 12: wherein the one or more flow orifices extend helically about a circumference of the flow trim. Element 13: wherein the flow trim comprises an annular wall and each flow orifice is defined through the annular wall at an angle offset from a longitudinal axis of the flow trim.

Element 14: wherein an annular channel is defined on an outer surface of the flow closure member and provides a first axial end and a second axial end opposite the first axial end, a radial projection extends radially inward from the sacrificial nose and is received within the annular channel and provides a first shoulder and a second shoulder opposite the first shoulder, and wherein actuating the flow closure member comprises moving the flow closure member from a closed position, where the one or more openings and the one or more flow orifices are occluded and the second axial end axially engages the second shoulder, to an intermediate location where the first axial end axially engages the first shoulder. Element 15: wherein moving the flow closure member to the intermediate location comprises axially displacing the flow closure member with respect to the sacrificial nose until the first axial end axially engages the first shoulder, and receiving an axial end of the flow closure member within the sacrificial nose. Element 16: wherein mitigating erosion of the flow closure member caused by the fluid with the sacrificial nose comprises moving the flow closure member toward an open position, where the one or more openings and the one or more flow orifices become progressively exposed to allow the fluid to flow through the one or more openings, and impinging the fluid against the sacrificial nose as the flow closure member moves toward the open position. Element 17: further comprising moving the flow closure member back toward the closed position, and axially displacing the flow closure member with respect to the sacrificial nose until the second axial end axially engages the second shoulder and the axial end of the flow closure member extends axially out of the sacrificial nose.

By way of non-limiting example, exemplary combinations applicable to A, B, and C include: Element 2 with Element 3; Element 2 with Element 4; Element 6 with Element 7; Element 6 with Element 8; Element 10 with Element 11; Element 12 with Element 13; Element 15 with Element 16; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed:

1. A flow control assembly, comprising:

a body defining a central flow passage and one or more lateral flow openings for fluid communication between the central flow passage and an exterior of the body;

a flow trim positioned within the central flow passage and defining one or more flow orifices aligned with the one or more lateral flow openings and wherein the one or more flow orifices extend helically about a circumference of the flow trim;

a flow closure member positioned within the central flow passage and movable between a closed position, where the one or more lateral flow openings and the one or more flow orifices are occluded to prevent fluid flow through the one or more lateral flow openings, and an open position, where the one or more lateral flow openings and the one or more flow orifices are at least partially exposed to facilitate fluid flow through the one or more lateral flow openings; and a sacrificial nose radially interposing the flow closure member and the flow trim to mitigate erosion of the flow closure member.

2. The flow control assembly of claim 1, wherein the sacrificial nose comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof.

3. The flow control assembly of claim 1, further comprising:

an annular channel defined on an outer surface of the flow closure member and providing a first axial end and a second axial end opposite the first axial end; and a radial projection extending radially inward from the sacrificial nose and received within the annular channel, the radial projection providing a first shoulder and a second shoulder opposite the first shoulder.

4. The flow control assembly of claim 3, wherein the radial projection exhibits a first axial length and the annular channel exhibits a second axial length greater than the first axial length such that an axial gap is formed between the first axial end and the first shoulder when the second axial end and the second shoulder are axially engaged, and such that the axial gap is alternatively formed between the second axial end and the second shoulder when the first axial end and the first shoulder are axially engaged.

5. The flow control assembly of claim 3, wherein the flow closure member is axially displaceable with respect to the sacrificial nose to axially displace the radial projection within the annular channel between the first and second axial ends.

6. The flow control assembly of claim 1, wherein the flow closure member is selected from the group consisting of a sliding sleeve, a rotating sleeve, a sliding plug, a rotating ball, an oscillating vane, an opening pocket, an opening window, a valve, and any combination thereof.

7. The flow control assembly of claim 1, wherein the flow trim comprises an annular wall and each flow orifice is defined through the annular wall at an angle offset from a longitudinal axis of the flow trim.

8. The flow control assembly of claim 1, wherein a width of at least one of the one or more flow orifices varies along an angular length of the at least one of the one or more flow orifices.

9. A well system, comprising:

a tubing string extendable within a wellbore, at least one flow control assembly coupled to the tubing string and including:

a body defining a central flow passage and one or more lateral flow openings for fluid communication between the central flow passage and an exterior of the body, wherein the central flow passage is in fluid communication with the tubing string;

a flow trim positioned within the central flow passage and defining one or more flow orifices aligned with the one or more lateral flow openings, wherein the one or more flow orifices extend helically about a circumference of the flow trim;

a flow closure member positioned within the central flow passage and movable between a closed position, where the one or more lateral flow openings and the one or more flow orifices are occluded to prevent fluid flow through the one or more lateral flow openings, and an open position, where the one or more lateral flow openings and the one or more flow orifices are at least partially exposed to facilitate fluid flow through the one or more lateral flow openings; and a sacrificial nose radially interposing the flow closure member and the flow trim to mitigate erosion of the flow closure member.

10. The well system of claim 9, wherein the sacrificial nose comprises an erosion-resistant material selected from the group consisting of a carbide grade, a carbide embedded in a matrix of cobalt or nickel, a ceramic, a surface hardened metal, a surface coated metal, a cermet-based material, a metal matrix composite, a nanocrystalline metallic alloy, an amorphous alloy, a hard metallic alloy, diamond, and any combination thereof.

11. The well system of claim 9, further comprising:

an annular channel defined on an outer surface of the flow closure member and providing a first axial end and a second axial end opposite the first axial end; and a radial projection extending radially inward from the sacrificial nose and received within the annular channel, the radial projection providing a first shoulder and a second shoulder opposite the first shoulder.

12. The well system of claim 11, wherein the radial projection exhibits a first axial length and the annular channel exhibits a second axial length greater than the first axial length such that an axial gap is formed between the first axial end and the first shoulder when the second axial end and the second shoulder are axially engaged, and such that the axial gap is alternatively formed between the second axial end and the second shoulder when the first axial end and the first shoulder are axially engaged.

13. The well system of claim 9, wherein the flow trim comprises an annular wall and each flow orifice is defined through the annular wall at an angle offset from a longitudinal axis of the flow trim.

14. A method, comprising:

introducing a tubing string into a wellbore, the tubing string having at least one flow control assembly coupled thereto and the at least one flow control assembly including:

a body defining one or more lateral flow openings for fluid communication between a central flow passage of the body and the wellbore, wherein the central flow passage is in fluid communication with the tubing string;

a flow trim positioned within the central flow passage and defining one or more flow orifices aligned with the one or more lateral flow openings, wherein the one or more flow orifices extend helically about a circumference of the flow trim;

a flow closure member movably positioned within the body; and a sacrificial nose radially interposing the flow closure member and the flow trim;

actuating the flow closure member to regulate a flow of a fluid through the one or more lateral flow openings; and mitigating erosion of the flow closure member caused by the fluid with the sacrificial nose.

15. The method of claim 14, wherein an annular channel is defined on an outer surface of the flow closure member and provides a first axial end and a second axial end opposite the first axial end, a radial projection extends radially inward from the sacrificial nose and is received within the annular channel and provides a first shoulder and a second shoulder opposite the first shoulder, and wherein actuating the flow closure member comprises:

moving the flow closure member from a closed position, where the one or more lateral flow openings and the one or more flow orifices are occluded and the second axial end axially engages the second shoulder, to an intermediate location where the first axial end axially engages the first shoulder.

16. The method of claim 15, wherein the moving the flow closure member to the intermediate location comprises:

axially displacing the flow closure member with respect to the sacrificial nose until the first axial end axially engages the first shoulder; and receiving an axial end of the flow closure member within the sacrificial nose.

17. The method of claim 16, wherein mitigating erosion of the flow closure member caused by the fluid with the sacrificial nose comprises:

moving the flow closure member toward an open position, where the one or more lateral flow openings and the one or more flow orifices become progressively exposed to allow the fluid to flow through the one or more lateral flow openings; and impinging the fluid against the sacrificial nose as the flow closure member moves toward the open position.

18. The method of claim 17, further comprising:

moving the flow closure member back toward the closed position; and axially displacing the flow closure member with respect to the sacrificial nose until the second axial end axially engages the second shoulder and the axial end of the flow closure member extends axially out of the sacrificial nose.

* * * * *